United States Patent [19]

Suzuki

[11] 4,382,475

[45] May 10, 1983

[54] HYDRAULIC HAMMERING APPARATUS

[76] Inventor: Tomio Suzuki, No. 7, Kanda-Nishiki-cho 2-chome, Chiyoda-ku, Tokyo, Japan

[21] Appl. No.: 265,334

[22] Filed: May 19, 1981

[30] Foreign Application Priority Data

May 23, 1980 [JP] Japan ..... 55-68540

[51] Int. Cl.[3] ..... B25D 9/04

[52] U.S. Cl. ..... 173/91; 173/134; 173/162 R; 91/50

[58] Field of Search ..... 173/90, 91, 128, 132, 173/134, 135, 138, 139, 162 R, 162 H, DIG. 2, 125, 127; 175/56; 91/50, 216 R, 232, 234, 325; 92/107, 108, 117 R, 168

[56] References Cited

U.S. PATENT DOCUMENTS

| | | | |
|---|---|---|---|
| 3,511,325 | 5/1970 | Schmidt | 173/132 X |
| 3,583,499 | 6/1971 | Cordes | 173/132 X |
| 3,788,402 | 1/1974 | Chelminski | 173/91 |
| 3,920,083 | 11/1975 | Makita | 173/91 X |
| 4,098,355 | 7/1978 | Gendron et al. | 173/127 |
| 4,214,638 | 7/1980 | Sudnishnikov et al. | 173/91 X |
| 4,284,147 | 8/1981 | Jenne | 173/91 |

FOREIGN PATENT DOCUMENTS

| | | | |
|---|---|---|---|
| 392206 | 1/1974 | U.S.S.R. | 173/125 |

*Primary Examiner*—James G. Smith
*Assistant Examiner*—Robert P. Olszewski
*Attorney, Agent, or Firm*—Murray and Whisenhunt

[57] ABSTRACT

This hydraulic hammering apparatus is so constructed that an upwardly opened fluid chamber is accommodated in a vertically movable manner within a longitudinal cylinder having a weight holding portion formed on the upper part of its top plate; the back of the top plate of the cylinder is sealingly connected with the opening of the fluid chamber by means of a diaphragm; water jet heads are provided oppositely to each other at the back of the top plate of the cylinder and the surface of the bottom plate of the fluid chamber respectively, said water jet heads being arranged to approach or space from each other in accordance with the vertical motion of the fluid chamber; and a hammering element is located between these water jet heads such that the upper and lower end parts of said element are sealingly fitted on or detached from the respective water jet heads.

6 Claims, 4 Drawing Figures

HYDRAULIC HAMMERING APPARATUS

BACKGROUND OF THE INVENTION

This invention relates to a hydraulic hammering apparatus, in particular a hydraulic hammering apparatus adapted for the purposes of driving and extracting piles and the like.

Although this invention is of course usable for the purposes other than driving and extracting of piles, its typical usage comprises driving and extracting of piles and therefore explanation will be made hereinafter with reference to this typical usage.

As conventional apparatuses of this type there may be enumerated the so-called drop hammering apparatus, steam hammering apparatus, Diesel hammering apparatus and so forth. However, in view of the hideous noise and vibration made by aforesaid conventional apparatuses there has been developed a vibrohammering apparatus in order to overcome the above trouble.

However, the fact is that this vibrohammering apparatus has not realized satisfactory results.

SUMMARY OF THE INVENTION

It is therefore an object of this invention to provide a hammering apparatus making low noise and vibration to such an extent that the above mentioned conventional vibrohammering apparatus has in no way achieved.

According to this invention, the aforesaid object can be achieved by a hydraulic hammering apparatus having such a construction as mentioned below. That is, this hydraulic apparatus is so constructed that an upwardly opened fluid chamber is accommodated in a vertically movable manner within a longitudinal cylinder having a weight holding portion formed on the upper part of its top plate; the back of the top plate of the cylinder is sealedly connected with the opening of the fluid chamber by means of a diaphragm; water jet heads are provided oppositely to each other at the back of the top plate of the cylinder and the surface of the bottom plate of the fluid chamber respectively, said water jet heads being arranged to approach or space from each other in accordance with the vertical motion of the fluid chamber; and a hammering element is located between these water jet heads such that the upper and lower end parts of said element are sealedly fitted on or detached from the respective water jet heads, wherein the pressurized water jetted from one water jet head delivers the other water jet head intermittent hammering through the hammering element, but this hammering, which takes place within the diaphragm and the fluid accommodated in the fluid chamber, acts to suppress the occurrence of noise and vibration.

It is another object of this invention to provide a hydraulic hammering apparatus which is capable of optionally changing a downward load as well as holding said load in a stabilized manner.

According to this invention, the aforesaid object can be achieved by constructing this hydraulic hammering apparatus so that a weight holding plate is disposed above the top plate of a cylinder; a plurality of weights are mounted detachably on this holding plate; a post is further disposed in the center of the holding plate, said post being provided at its upper end with a hook serving for the purpose of hanging the apparatus in its entirety; a radial groove is perforated in each weight from its peripheral flange up to a site passing its center; and the post is fitted in said groove.

It is a further object of this invention to provide a hydraulic hammering apparatus which is capable of exerting a force downwards or upwards to thereby result in a slight vertical vibration simultaneously and performing operations efficiently by utilizing the resulting vertical force.

According to this invention, the aforesaid object can be achieved in such a manner that when exerting a force downwards, a necessary and constant statical load is applied on an article being handled by means of weights located above the cylinder and simultaneously vibrations are exerted thereon which result from intermittent hammering of the lower water jet head by the hammering element, while when exerting a force upwards, a constant statical load is applied on an article being handled by means of a hanging means for suspending the cylinder and simultaneously vibrations are exerted thereon which result from intermittent hammering of the upper water jet head by the hammering element.

DETAILED DESCRIPTION OF THE INVENTION

Figure 1:
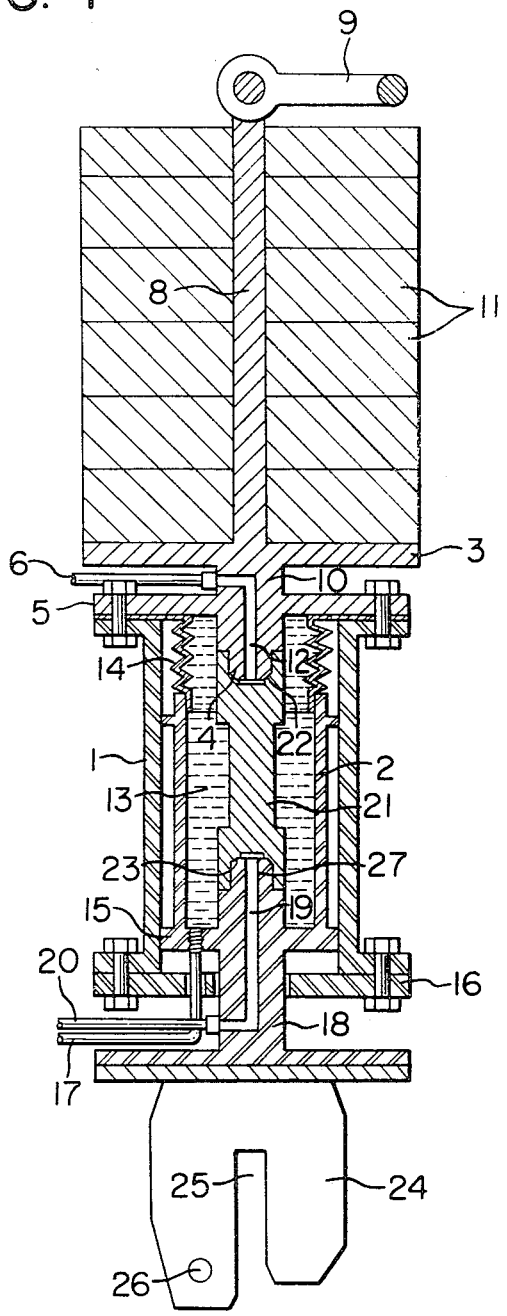
FIG. 1 is a cross-sectional vertical front view illustrating the state of a hydraulic hammering apparatus according to this invention in its rest position.

FIG. 1 illustrates a hydraulic hammering apparatus according to this invention in its rest position, wherein an upwardly opened fluid chamber 2 is accommodated within a longitudinal cylinder 1 and further a flange is provided at the upper outer periphery of the chamber 2 and the outer periphery of a bottom plate 15 are fitted slidably on the inner periphery of the cylinder 1.

A vertically projecting column 10 is disposed in the center of a top plate 5 of the cylinder 1, the upper part of said column 10 being provided with a weight holding plate 3. A post 8 is erected in the center of the upper part of the holding plate 3. A hanging hook 9 is provided at the upper end of said post, and a wire 7 (see FIG. 2) of a hoisting equipment (not shown) such as a crane or the like is fastened to the upper end of said hook.

A reduced diameter water jet head 4 is formed at the lower end of the column 10, a fluid passage 12 having an outlet at the tip of said head 4 is formed within the column 10, a pipe 6 is connected with the inlet of this passage, and a pressurized fluid is supplied to this pipe 6 from a pump (not shown).

Numeral 11 denotes a plurality of weights mounted on the holding plate 3, the weight of each normally being about 1 ton. The weight is provided with a radial groove (not shown) extending from its peripheral flange up to a site passing its center, and said groove fits detachably onto the post 8 in the vicinity of its center. Mounting of a spring in place of the lowermost weight 11 can increase the number of vibrations.

The upper edge of a diaphragm 14 is sealedly mounted on the back of the top plate 5, while the lower edge of said diaphragm 14 is sealedly mounted on the upper edge of the chamber 2. And, the inside of the chamber 2 and the diaphragm 14 are completely filled with fluid 13.

In the rest position as illustrated in FIG. 1, the chamber 2 is held by the diaphragm 14 so that the bottom plate 15 of the chamber 2 is allowed to locate above the bottom plate 16 of the cylinder 1 at a fixed distance therefrom. The bottom plate 15 is provided with a tapped hole, and a discharge pipe 17 after having passed through the bottom plate 16 is connected at its upper end with the tapped hole. In the center of the bottom plate 15 there is provided a vertically projecting column 18. A reduced diameter water jet head 27 is formed at the upper end of this column 18, a fluid passage 19 having an outlet at the fore end of this head 27 is formed within the column 18, a pipe 20 is connected with an inlet of said passage, and a pressurized fluid is supplied to this pipe 20 by means of a pump (not shown). A hammering element 21 is disposed between the water jet heads 4 and 27, and the heads 4 and 27 are sealedly and slidably fitted in recesses 22 and 23 formed in the upper and lower end portions of said hammering element 21.

The column 18 passes through the bottom plate 16 of the cylinder 1 and then extends downwards, and a chucking means 24 is fixed to the lower end of the column 18. Numeral 25 denotes a chucking slot and numeral 26 denotes a hole for wire-binding.

Explanation will be made on the operation of the apparatus as constructed above.

First of all, explanation will be made on the operation of driving a pile with reference to the abovementioned apparatus.

The apparatus in the state as illustrated in FIG. 1 is suspended by suspending the wire 7 (see FIG. 2) of a crane (not shown) on the hook 9 and then is placed on a pile 28 (see FIG. 2) erected on the surface of the earth as that the pile 28 may be fitted in the chucking slot 25, and thereafter the tensile force of the wire 7 is loosened for imposing the total weight of the apparatus on the pile 28.

After that, when a pressurized fluid is supplied to the passage 12 of the column 10 by way of the pipe 6, the resulting pressure is applied on the recess 22 of the hammering element 21 and the latter is thus pressed down. This is accompanied by descent of the chamber 2 and further of the column 18 provided in the bottom plate 15 of the chamber, whereby the pile chucked by the chucking means 24 is thrusted in the earth.

Figure 2:
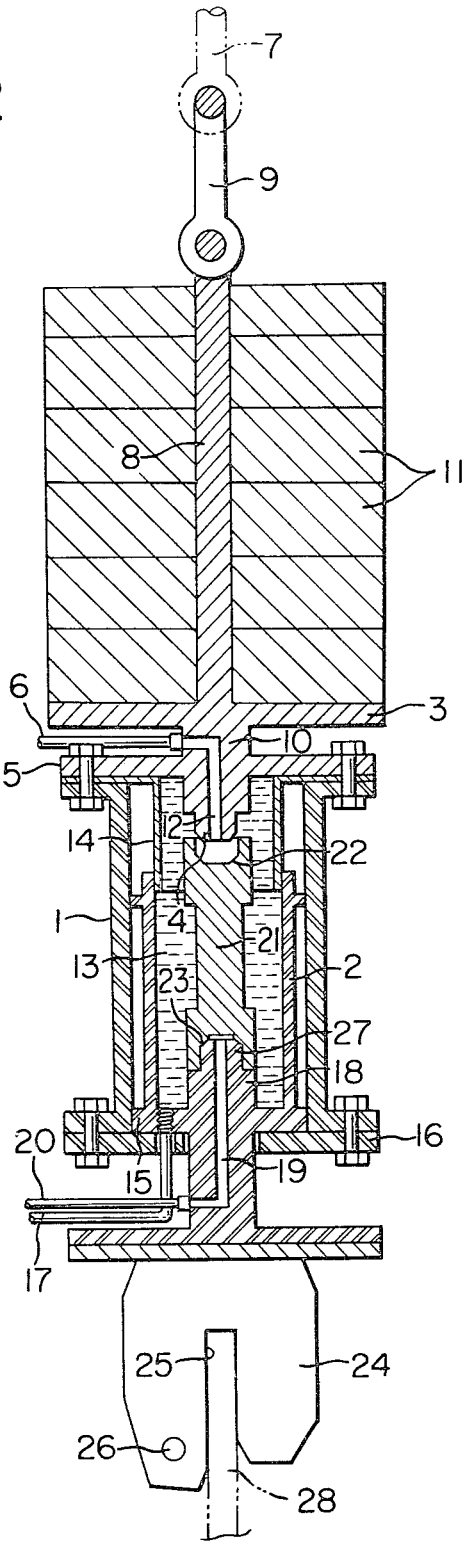
FIG. 2 is a cross-sectional vertical front view illustrating the hammering state of the apparatus of FIG. 1 at the time when a downward force is applied thereon.

This permits the head 4 and the recess 22 of the hammering element 21 to space from each other as shown in FIG. 2, whereby the fluid within the recess 22 jets in the chamber and thus the pressure within the recess 22 drops suddenly.

When the tensile force of the wire 7 is loosened, the cylinder 1 descends by the weight of weights 11 and restores the position illustrated in FIG. 1, thereby allowing the head 4 to hammer at the hammering element 21. At this time, said excess fluid jetted out of the passage 12 in the chamber 2 is discharged to the outside by way of an exhaust pipe 17.

The thus ascended hammering element 21 descends again through the exactly same procedure as abovementioned by the action of the fluid conveyed along the passage 12. This alternate descent of the hammering element 21 and cylinder 1 is repeated so far as the supply of fluid to the passage 12 is continued. Due to the hammering by this alternately descending hammering element 21 there are caused vertical vibrations all over the apparatus. And, driving of the pile 28 can be carried out efficiently by co-operation of thus caused vibrations with the pressing force of hammering element 21 and the weight of weights 11.

Next, explanation will be made on the operation of extracting a pile with reference to the abovementioned apparatus.

Figure 3:
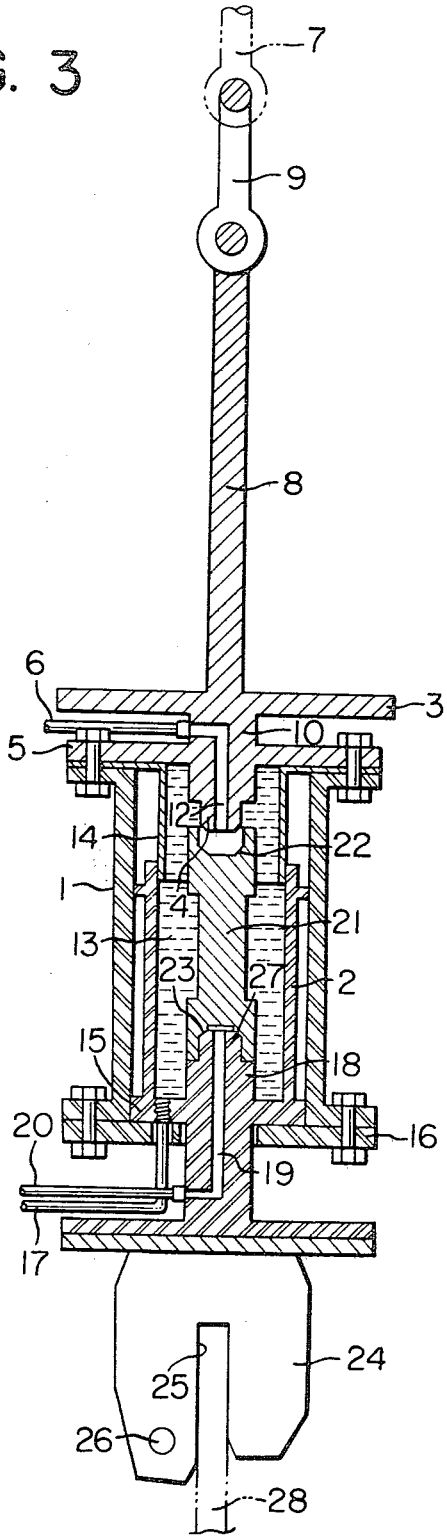
FIG. 3 is a cross-sectional vertical front view illustrating the non-hammering state of the apparatus of FIG. 1 at the time when an upward force is applied thereon.

In this case, all the weights 11 are removed as shown in FIG. 3 and the head portion of the pile is fitted in the chucking slot 25. Thereupon, the pile is clamped on the chucking means with a wire making use of the hole 26 and the apparatus in its entirety is suspended with the wire 7 through the hook 9 so that the pile 28 is subjected to an upward force. In this case, the chamber 2 is seated on the bottom plate 16 of the cylinder 1. In this situation, when a pressurized fluid is supplied in the passage 19 by way of the pipe 20, the pressure is applied in the recess 23 of the hammering element 21 to thrust it up, whereby the head 4 of the column 10 is hammered by the upper end portion of the hammering element 21. This permits the cylinder 1 to which this column 10 is fixed, namely the chamber 2 seated thereon to lift up instantly and consequently to lift up the pile clamped thereon.

Figure 4:
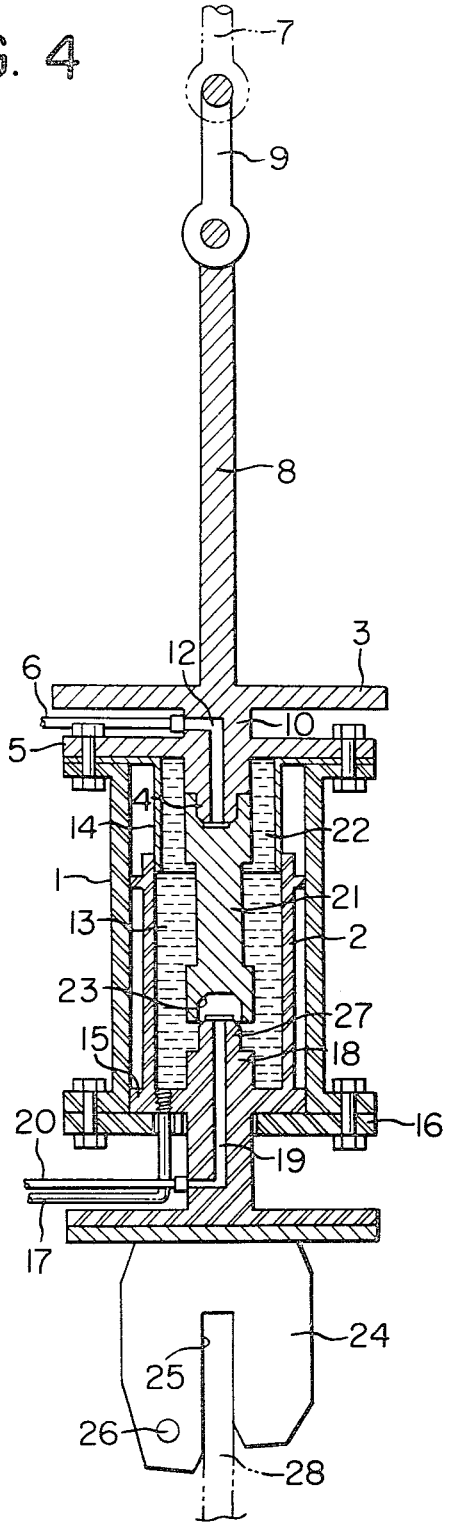
FIG. 4 is a cross-sectional vertical front view illustrating the hammering state of the apparatus of FIG. 3.

This allows the head 27 and the recess 22 of the hammering element 21 to space from each other as illustrated in FIG. 4, whereby the fluid within the recess 22 jets in the chamber 2 to cause the same phenomenon as seen in the case of driving the pile and the excess fluid is thus discharged to the outside through the exhaust pipe 17.

Due to the abovementioned ascent and descent of the hammering element 21 there are caused vertical vibrations all over the apparatus in the exactly same manner as seen in the case of driving the pile. And, extracting of the pile 28 can be carried out efficiently by co-operation of thus caused vibrations with the tensile force of wire 7.

In any case of said driving and extracting operations, the hammering element 21 is designed to collide with the head 4 or 27, wherein, however, there is no possibility of a noise made by said collision leaking out to the outside because the collision takes place in the fluid 13 and said noise is absorbed by the fluid 13 and further there is no possibility of a heavy vibration being made by the collision because the hammering element 21 inevitably has a reduced stroke.

As is evident from the aforegoing, the apparatus according to this invention may be said advantageous in that it can be suitably used especially in cities and the like where noise and vibration are hated because it is capable of driving not only piles but also their similarities in and extracting them from the earth without causing noise and vibration, and further in that it per se can be utilized additionally in devices such as a grinder and the like.

Although particular preferred embodiments of the invention have been disclosed hereinabove for purposes of illustration, it will be understood that variations or modifications thereof which lie within the scope of the invention as defined by the appended claims are fully contemplated.

What is claimed is:

1. A hydraulic hammering apparatus wherein an upwardly opened fluid chamber is accomodated in a vertically movable manner within a longitudinal cylinder having a weight holding portion formed on the upper part of its top plate; the back of the top plate of the cylinder is sealedly connected with the opening of the fluid chamber by means of a diaphragm; water jet heads are provided oppositely to each other at the back of the top plate of the cylinder and the surface of the bottom plate of the fluid chamber respectively, said water jet heads being arranged to approach and space from each other in accordance with the vertical motion of the fluid chamber; and a hammering element is located between these water jet heads such that the upper and lower end parts of said element are formed for sealedly engaging and for disengaging from the respective water jet heads.

2. A hydraulic hammering apparatus according to claim 1 wherein above and spaced from the top plate of said cylinder, a weight holding plate is connected with the top plate by means of a column, a post is erected in the center of said weight holding plate, and a hanging hook is attached to the upper end of said post.

3. A hydraulic hammering apparatus according to claim 2 wherein a plurality of weights are mounted detachably on said weight holding plate, a radial groove is perforated in each of said weights from its peripheral flange up to a site passing its center, and when said weights are mounted on the holding plate the post is fitted in said groove so as to hold each of said weights.

4. A hydraulic hammering apparatus according to claim 2 wherein said water jet head located at the back of the top plate and a fluid passage opening in said water jet head are formed at the lower end of said column, and an inlet of said fluid passage opens in the side of the column between the top plate of the cylinder and the weight holding plate.

5. A hydraulic hammering apparatus according to claim 1 wherein below and spaced from the bottom plate of said fluid chamber, a chucking means is connected with said bottom plate by means of a column passing through the bottom plate of the cylinder.

6. A hydraulic hammering apparatus according to claim 5 wherein said water jet head located at the surface of the bottom plate of the fluid chamber and a fluid passage opening in said water jet head are formed at the upper end of said column, and an inlet of said fluid passage opens in the side of the column downstream of the bottom plate of the cylinder.

* * * * *